United States Patent [19]

Tamaru et al.

[11] 4,232,510

[45] Nov. 11, 1980

[54] TIMEPIECE

[75] Inventors: Munetaka Tamaru, Tokyo; Akira Tsuzuki, Ooizumigakuen; Shigeru Morokawa, Higashiyamato; Minoru Watanabe; Kazunari Kume, both of Tokorozawa; Hideshi Oono, Sayama, all of Japan

[73] Assignee: Citizen Watch Co., Ltd., Tokyo, Japan

[21] Appl. No.: 772,934

[22] Filed: Feb. 28, 1977

Related U.S. Application Data

[63] Continuation-in-part of Ser. No. 616,053, Sep. 23, 1975, abandoned.

[30] Foreign Application Priority Data

Sep. 25, 1974 [JP] Japan ..... 49-110202

[51] Int. Cl.[2] ..... G04B 19/24; G04C 3/00; G04B 27/00

[52] U.S. Cl. ..... 368/28; 368/34; 368/76; 368/185

[58] Field of Search ..... 58/4 A, 23 R, 50 R, 58/39.5, 85.5

[56] References Cited

U.S. PATENT DOCUMENTS

| | | | |
|---|---|---|---|
| 2,944,384 | 7/1960 | Rabinow | 58/109 X |
| 3,039,262 | 6/1962 | Dicke | 58/85.5 |
| 3,333,410 | 8/1967 | Barbella | 58/23 R X |
| 3,646,751 | 3/1972 | Purland et al. | 58/152 |
| 3,702,530 | 11/1972 | Besson et al. | 58/85.5 |
| 3,733,810 | 5/1973 | Girard | 58/4 A |
| 3,823,545 | 7/1974 | Vittoz et al. | 58/23 R |
| 3,839,850 | 10/1974 | Dargent | 58/4 A |
| 3,842,590 | 10/1974 | Kato | 58/58 |
| 3,916,612 | 11/1975 | Morokawa et al. | 58/23 R |
| 3,962,861 | 6/1976 | Protta et al. | 58/39.5 |

FOREIGN PATENT DOCUMENTS

| | | | |
|---|---|---|---|
| 987503 | 4/1976 | Canada | 58/23 R |

*Primary Examiner*—Vit W. Miska
*Attorney, Agent, or Firm*—Sherman & Shalloway

[57] ABSTRACT

Timepiece comprising means for attaining the function of measuring the time, a time display means, at least part of which is mechanically formed, a means for changing the displayed content of the time display means in response to the operation of an external actuating member and a means for setting information for setting the condition of a timepiece function in accordance with the operation of the external actuating member, the time display means serving as the display of the information to be set upon the setting of the information whereby there may be easily effected the setting of functions except the time setting without increase of the complication of the display means.

6 Claims, 14 Drawing Figures

FIG. 6
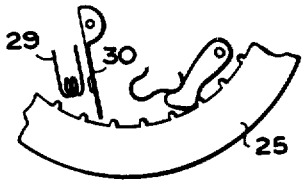
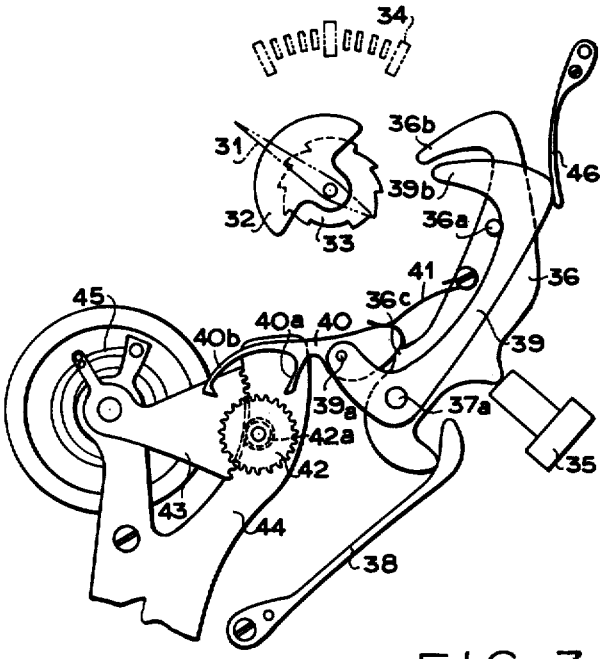
FIG. 7

TIMEPIECE

CROSS-REFERENCE TO RELATED APPLICATION

This is a continuation-in-part of our copending application Ser. No. 616,053 filed on Sept. 23, 1975, now abandoned.

FIELD OF THE INVENTION

This invention relates to a timepiece with a suitable display used to indicate a latent function thereof.

BACKGROUND OF THE INVENTION

A timepiece has the primary object of indicating time and other information such as the date and/or the day as the primary function. Recently, it has been possible to provide a timepiece with more complicated functions as the secondary functions, some of which have information to be indicated on setting or during operation, but the necessity of indication is somewhat less important on ordinary conditions.

For example, in the highly programmed timepiece that has the function of automatic correction of date at the end of the month as the second function, information on year and month needs to be indicated on the dial. In this case, the indication of the information on year and month is necessary to be made only while setting the real date and/or day and less important otherwise because the user always remembers the real year and month. Furthermore, in situations where the timepiece with a slow and fast adjusting member is operable outside of the case as the second function, it is difficult to precisely control the amount of adjustment, if the amount is controlled by the rotational angle of the adjusting spindle or the like. Such a manner of adjustment is not applicable to highly precise timepieces such as those of the crystal oscillator type.

It is desirable to indicate other situations than the above. For example, in timepieces with a chronographic second function, the designation of the time-measuring mode in a chronograph: namely, the previous setting of the mode for split hand, for time interval, for integrating or for zero-reset, in timepieces with an alarm device as the second function which is capable of setting a plurality of alarming times, the setting of the alarming time in the watch or clock or the designation of the figure to be corrected on the setting operation in the digital watch or clock needs to indicate information.

If the information on the various kinds of functions set forth above is always indicated on the timepiece dial, the display surface would be unduly complicated.

SUMMARY OF THE INVENTION

A primary object of this invention is to provide a timepiece having means for indicating information other than the time, date and day without causing complication of the display surface.

According to this invention, the information other than the time, date and day are indicated using the fundamental element of the timepiece, such as hands and a scale on the dial, register ring or calendar wheel.

Other features and advantages of this invention will be more clearly understood from the following description with reference to the accompanying drawings, in which:

IN THE DRAWINGS

FIG. 6 shows in a plan view the mechanism for driving the date wheel; and

FIGS. 7 to 9 are plan views of another embodiment of this invention applied to a timepiece with slow and fast adjusting mechanisms embodying this invention, respectively;

DESCRIPTION OF THE PREFERRED EMBODIMENTS

Figure 2:
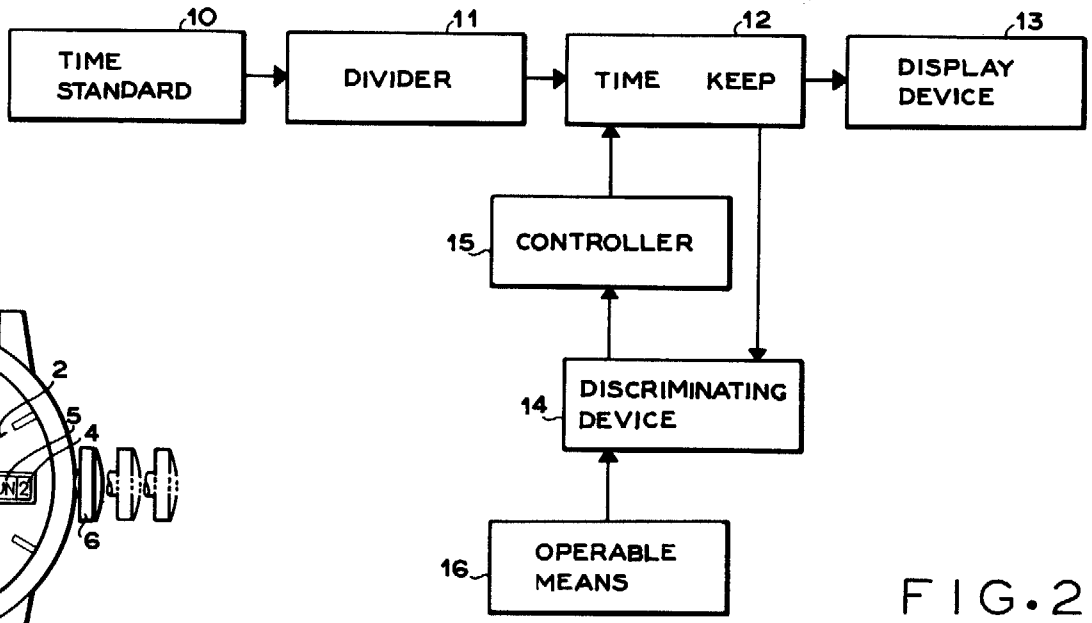
FIG. 2 is a block diagram showing a part of the elements of the timepiece of FIG. 1.

In FIGS. 1 to 4 there is shown an electronic timepiece with a crystal oscillator which is used as a time standard. The timepiece comprises an hour hand 1, minute hand 2, second hand 3, a first display cell 4 for indicating date and a second display cell 5 for displaying the day. These are disposed on a display surface formed in a case. The timepiece includes means for automatically correcting the indication of the date at the end of the months with less than 31 days.

The reference numeral 6 indicates a crown which is provided for correcting the indication of date and day and for adjusting time. In this embodiment, the correction of date is performed by pulling out the crown for one step and rotating it in one or the other direction and the time adjustment is made by pulling out the crown for two steps and rotating it in the desired direction. A month correcting button 7 can generate a signal corresponding to one of the numerals from 1 to 12 which is shown by the display cell 4 for indicating date, when pulled out. The signal thus obtained is memorized in an electronic memory (not shown). Furthermore, the timepiece includes a first circuit for a time-keeping system and a second circuit for a calendar system in which a calendar for a year has been programmed.

When, for example, correcting the timepiece at ten minutes past five on February 15, the crown 6 is at first pulled out one step and rotated in the predetermined direction until the numeral 2 is indicated on the display surface of the element 4 and then the button 7 is pulled out at once and pushed in. Thereafter, the crown 6, at the position pulled out one step, is rotated in the same direction until the numeral 15 is shown on the display surface of the element 4 and then pulled out for further one step for adjustment of time in the conventional manner.

FIG. 2 shows the basic system of the timepiece described above which comprises a source of a time standard signal generator 10, a frequency divider 11, a time-keeping and additional function attaining means 12 and a display device 13. Additionally, a device 14 for discriminating between the operating instructions, a controller 15 and operable means 16 are provided.

Figure 1:
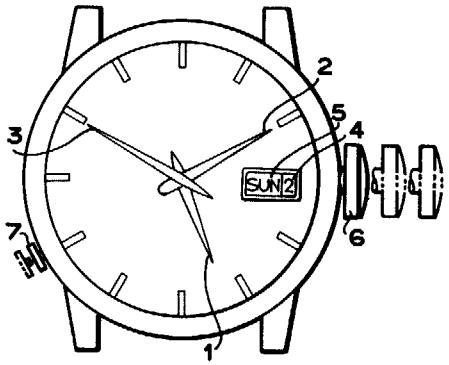
FIG. 1 is a plan view of the timepiece embodying this invention.

The operable means 16 is capable of selecting one of the states and corresponds to the crown 6 and button 7 in FIG. 1. The controller 15 acts to determine the operation of the timepiece according to the combination of the kept time or memorized calendar and the state selected by the operable means 16.

Referring to the control with reference to the timepiece shown in FIG. 1 the date information showing the 2nd day is supplied from the time-keeping device to the discriminating device 14 to which other information is obtained by operating the operable means 16. The information from the discriminating circuit 14 showing the 2nd day is supplied to the controller 15 as information showing the second month, i.e., February. The output of the controller 15 is supplied to the time-keeping and additonal function attaining means 12 for memorization.

Figure 3:
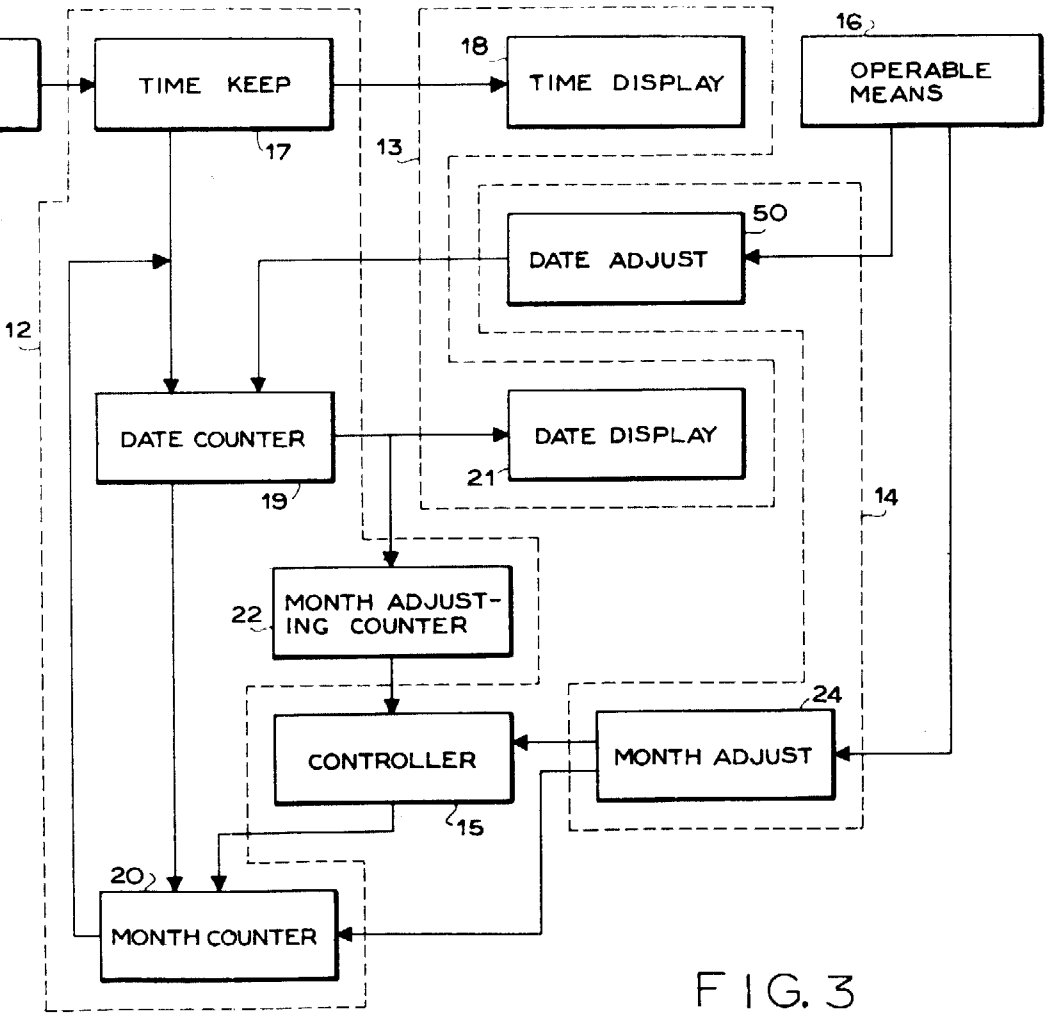
FIG. 3 is a block diagram showing a part of the element of the timepiece shown in FIG. 1 more in detail.

In FIG. 3, which shows the system of FIG. 2 in more detail, the reference numeral 17 indicates a time-keeping device wherein there is provided one embodiment in case that the date display indicates the month setting information in an automatic end of month control timepiece, 18 a display device, 19 a date counter and 20 a month counter. The month counter 20 is driven by the date counter 19 and controls the date counter at the end of the months with less than 31 days.

A date display device 21 displays the content of the date counter 19 and a month-adjusting counter 22 counts the output signal of the date counter 19. The output of the month-adjusting counter 22 is fed to a controller 15 which is normally closed and actuated by a signal from a month-adjusting means 24 which generates a signal when operated to reset the month counter 20 and a signal to actuate the controller 15, so that the content of the month-adjusting counter 22 is set at the month counter 20. Referring to the construction of FIG. 1, the reset operation is made by pulling out the button 7 and the set operation is performed by pushing down it. The reference numeral 50 indicates date adjusting means.

Figure 4A:
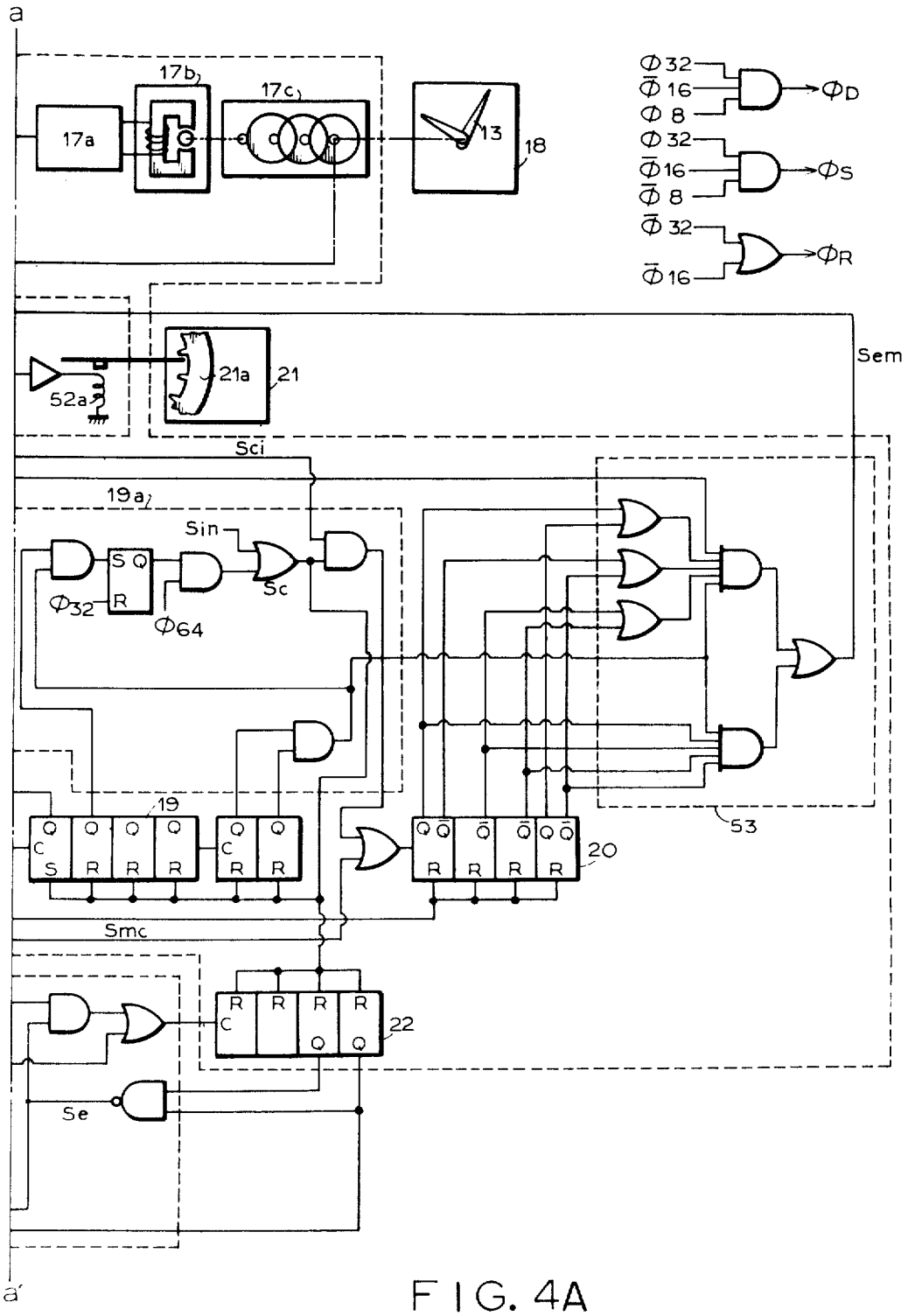
FIG. 4 is a more detailed diagram showing the content of a block diagram of FIG. 3.
Figure 4B:
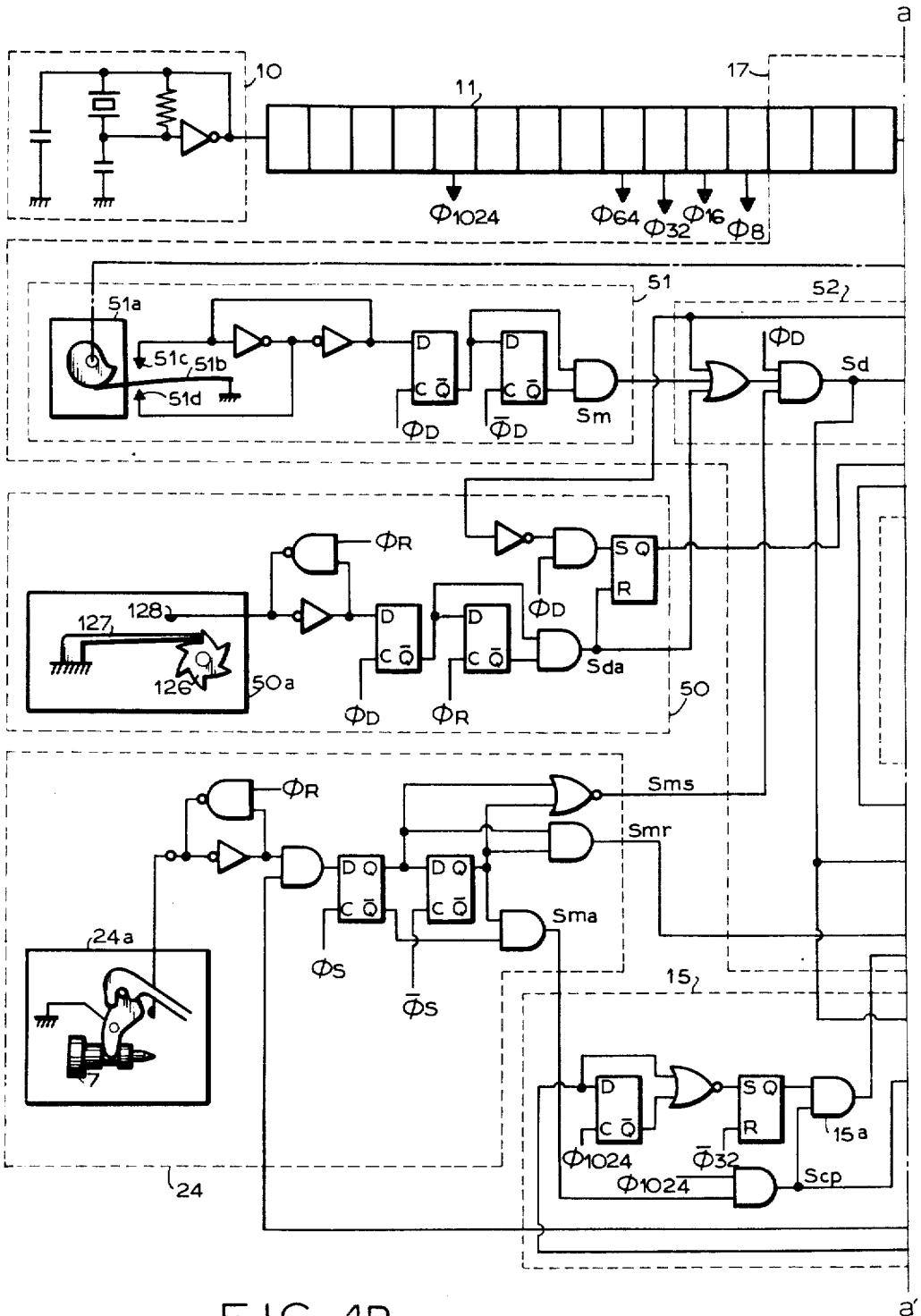

FIG. 4 shows a more detailed embodiment of a system shown in FIGS. 2 and 3 wherein like references depict like parts. The crystal oscillator 10 as a time standard is connected with the frequency divider 11 composed of binary counters for dividing the output frequency of the oscillator 10. Flip-flops forming the last several stages of the frequency divider 11 may be reset by means of an external actuator (not shown) which is conventional. Reference numeral **17*a* denotes a motor driving circuit supplying the coil of a motor 17*b* with a pulse-shaped driving current in synchronism with the output signal from the frequency divider 11. The rotor of the motor 17*b* is stepped in accordance with the driving current by a given angle. A wheel train 17*c* mechanically decelerates the movement of the rotor. Hands 13 composed of the minute and hour hands are pivoted on the axis of the wheel train 17*c*. A time display 18 comprises the hands 13** and a dial. The above structure is not different from the prior art arrangements.

Signals $\phi$8, $\phi$16, $\phi$32, $\phi$64 and $\phi$1024 are derived from each division stage of the frequency divider 11 and have 8 Hz, 16 Hz, 32 Hz, 64 Hz and 1024 Hz with duty of 50% respectively. These signals pass through AND gate or OR gate that clock pulses $\phi$D, $\phi$S and $\phi$R may be generated as shown in the right-upper part of FIG. 4.

Reference numeral 51 depicts a midnight detector comprising a cam **51*a* associated with the wheel train 17*c* and rotating once every 24 hours, a spring piece 51*b* moved by the cam 51*a*, two contacts 51*c* and 51*d* detecting the movement of the spring piece 51*b*** and a circuit generating the pulse signal, i.e., midnight signal Sm having a constant width and generated once every one return trip.

A date driver 52 is connected to the output of the midnight detector 51 and generates a date drive signal having the width similar to that of a clock pulse $\phi$D when there is high any of Sm, date adjusting signal Sd*a* and end of the month signal Sem, thereby applying a drive coil **52*a* with a current. While the date driver 52 does not generate the date drive signal Sd when a month setting signal Sms is low. The date counter 19 comprises a decimal counter provided with a set terminal and two bit counter for counting numbers of one through thirty-one. The date drive signal Sd is applied to the clock input terminal of the date counter 19. The month counter 20 is composed of a duodecimal counter for counting zero through eleven. Reference numeral 19*a* denotes a carry generator and 53 denotes an end of month detector belonging to both the date and the month counters and automatically correcting the end of the month. The carry generator 19*a* functions to detect the condition when the date counter 19 becomes 32, to generate a carry signal Sc in accordance with the timing of a signal $\phi$64 so as to set the date counter 19 to one and the month adjusting counter 22 to zero. At this time, the carry generator 19*a* also adds one to the month counter 20 when a carry inhibit signal Sci is high. The end of month detector 53 detects the 31st day of the months with less than 31 days and the 30th and 31st days of February so as to make the end of month signal Sem high, thereby generating the date drive signal Sd in synchronism with the signal $\phi$D and as the result, a date plate 21*a* is driven successively. The month adjusting counter 22 comprises a four bit binary counter provided with reset terminals. All the frequency divider 11, the date counter 19, the month counter 20 and the month adjusting counter 22** are operated in synchronism with trailing edge of the signal applied to clock terminals. Other data-type flip-flops except the above are operated by the leading edge of the signal applied to clock terminals.

A date adjuster 50 comprises a mechanical operation descriminating mechanism (FIGS. 10–14) and a circuit detecting the closing of a switch **24*a* which is turned on or off by rotation of the winding crown 6 (FIG. 1**) so as to generate a date adjusting signal Sda and carry inhibiting signal Sci.

The month adjuster 24 is connected to the month counter 20 and a controller 15 set forth later and comprises a switch **24*a* operating when a button 7** is pulled out and a circuit detecting the closing of the switch so as to make a month setting signal Sms low and a month reset signal Smr high, and detecting the opening of the switch to generate a month adjusting signal Sma in accordance with the timing equal to that of the clock signal $\phi$s and to make the month setting signal Sms high. When an enable signal Ses is low, the signal is prevented from occurring.

The controller 15 receives signals from the month adjusting counter 22 and the month adjuster 24 and deliver the output signal to the month counter 20, and detects that the month adjusting counter 22 becomes twelve so as to make the enable signal Se low and to inhibit the month adjustment and simultaneously inhibit the date drive signal and thereby the month adjusting counter 22 stops counting. When the count number of the month adjusting counter 22 is less than eleven the month adjustment can be effected. In this case, the month adjusting signal Sma is generated and there occur 16 count pulse signls Scp so that the month adjusting counter 22 is made a round. As the result, the overflow of the month adjusting counter 22 is detected so that the month count gate 15*a* may be turned on, whereby the remains of the count pulses Scp are delivered as a month count signal Smc.

Hereinafter the operation will be described. Let the initial state set as follows. When the date display 21 indicates the first day, there are generated an initializing signal Sin and a carry signal Sc, and the date counter 19 is set to one and the month adjusting counter 22 is set to zero. The contents of the month counter 20 are considered that "zero" shows January, "one" February . . . "eleven" December. The initializing signal Sin may be manually operated once after a battery cell is set or may be generated by detecting the position of the date plate 21*a* by means of a switch, etc.

In the time-keep mode, the spring piece 51*b* falls from the protrusion of the cam 51*a* into the recess thereof at 12 hours midnight so that the data terminal of the flip-flops changes from "high" to "low" thereby generating a midnight signal Sm, and as the result, a date driving signal Sd arises. Thus, a current is applied to a driving coil 52*a* so that the date plate 21*a* is advanced by one step. The date counter 19 is added by one at the trailing edge of the date drive signal Sd. When it is before 12th day, the month adjusting counter 22 is also added by one. At the 12th night the content of the month counter 20 is eleven, the date drive signal Sd makes the date counter 19 to 13 and the month adjusting counter 22 to 12, then the enable signal Ses becomes low so that the content of the month adjusting counter 22 does not increase. Thus, it is advanced by one day every one night. At the end of the months with days less than 31 days, the date plate 21*a* is driven by one day at night so that the date counter 19 increases one whereby the end of month detector 53 operates after appearance of the display of the 31st day on the months with days less than 31 days or of that of the 30th day on February and as the result the end of month signal Sem becomes high. The date driver 52 generates a date drive signal Sd in synchronism with the signal $\phi$D so as to drive the date plate 21*a* whereby the content of the date counter 19 is increased. This operation is repeated until the content of the date counter 19 becomes 32. When the content of the date counter 19 becomes 32, the date plate 21*a* indicates the 1st day next to the 31st day. Then the carry generator 19*a* operates to generate a carry signal Sc, thereby making the content of the date counter 19 set to one and that of the month adjusting counter 22 to zero and as the result, that of the month counter 20 is advanced by one. This results in that the end of month signal Sem is low.

Nextly, the correction of the date will be described as follows:

When the winding crown 6 is pulled out by one stage and rotated so that there may occur a date correcting mode. The date correcting switch 50*a* which is open while the time-keep mode is turned closed and open contact, and when it changes from closed to open the date adjusting signal Sda is generated. The date driver 52 generates a date drive signal Sd in synchronism with the signal $\phi$D so as to drive the date plate 21*a*, thereby driving the date counter 19, the month adjusting counter 22. This driving operation is equivalent when the midnight signal Sm appears. While the date adjusting signal Sd*a* resets the carry inhibiting signal Sci at "low" so that the carry toward the month counter 20 is inhibited. The carry inhibiting signal Sci is immediately reset at "high" by the signal $\phi$D when the end of month signal Sem is absent. When the end of month signal Sem is present, the carry inhibiting state is maintained during the automatical correction for the end of the month so that the end of month signal Sem becomes low whereby the carry inhibiting signal Sci is set at "high" by the first signal $\phi$D.

Month correction will be described.

There is effected the month correcting mode when the button is pulled out. When the month correcting switch 24*a* is closed, the month setting signal Sms becomes low so as to inhibit the date drive signal Sd whereby the date display 21 and the date adjusting counter 22 are made unmovable. As the result, the month reset signal Smr becomes high and the month counter 20 is made zero. When the button 7 is depressed, the month correcting switch 24*a* is opened and the month reset signal Smr returns to low so that the month adjusting signal Sma appears in synchronism with the signal $\phi$S. While the controller 15 generates 16 count pulses Scr so as to make a round the month adjusting counter 22. When there is detected the overflow of the month adjusting counter 22, the month counter gate 15*a* is opened and the remains of the count pulses Scp are delivered as the month count signal Smc to the month adjusting counter 22 so that count-up may be effected. For example, when the date display 21 shows two, the month adjusting counter 22 shows one and the month counter 20 is reset to zero. The trailing edge of the 15th count pulses Scr makes the output of the most upper digit of the month adjusting counter 22 "low" from "high" whereby the set-reset flip-flops are set and as the result, the month counter 20 is opened. The 16th count pulse makes the month adjusting counter 22 return to the initial one and simultaneously set the month counter 20 at one. Thus, the content of the month adjusting counter 22 is shifted to the month counter 20. When the date display 21 indicates the number more than thirteen, the month adjusting counter 22 shows twelve and the enable signal Ses low and as the result, the month correcting operation is made invalid.

Modified embodiment of the above will be described.

The above embodiment comprises the month adjusting counter 22 to correlate the number displayed by the date display 21 with the month counter 20. However, this composition is not essential. Namely, the structure shown in FIG. 5 without the month adjusting counter 22 may be used. In this case, a presetable counter is utilized as the month adjusting counter 22.

Further, the content of the month counter 20 may be reset directly by means of a month counter composed of a presetable counter.

Furthermore, in date driving, the output of the date counter 19 is utilized such that seven segment character elements may be driven through a decoder.

Figure 5:
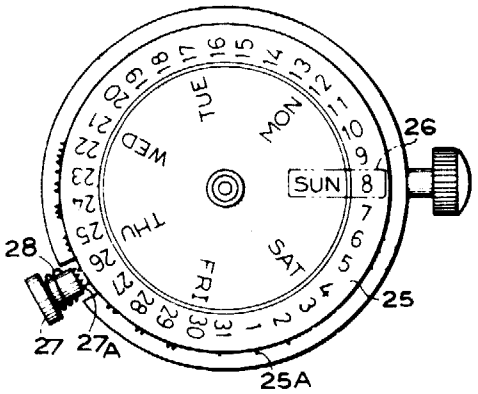
FIG. 5 is a plan view showing the date wheel and a device for detecting the code showing the month.

FIGS. 5 and 6 illustrate another timepiece embodying this invention wherein the information on the date and day is indicated by a mechanical display device and the adjustment of the date indication performed at the end of the months with thirty or less days is made electrically.

FIG. 5 of a modified embodiment of FIG. 4, there is shown a construction of the controller 15 (FIG. 3) which comprises a date wheel 25, on the outer periphery of which are provided plural sets of small projections or terminals. The terminals in each set are binary coded and located in order to convey the information on the numeral shown in a window 26 to a button 27 which is supported for axial movement and biased outwardly by a spring member 28. When the button 27 is pushed inwardly by manual operation, terminals disposed on the button 27 will contact with one of the terminal sets to generate a signal which is used to show information on the month. In FIG. 4, since an "8" is shown in the window, the timepiece will correct for the month of "August."

Although the above description has been made to the adjustment of the month, it is possible to program yearly information, thereby eliminating the manual operation in leap years.

The driving mechanism for the date wheel 25, as shown in FIG. 6 of one embodiment showing a date driving mechanism of FIG. 4, comprises a driving coil 29 and a feed member 30. When a switch (51*b.c.d*) which is associated with the timepiece mechanism is turned on at twelve o'clock midnight, the feed member 30 is attracted toward the coil 29, thereby indexing the date wheel one step to change the indication of date. An electric circuit of FIG. 4 including a month counter and a date counter which is associated with the date wheel produces two energizing signals at midnight on 30th day of each month with 30 days to display the indication of "1st day" in the window.

There will be described by FIGS. 10 to 14 the crown as the operable means in the date adjusting means and the mechanical parts in the discriminating device as shown in FIG. 4.

Figure 10:
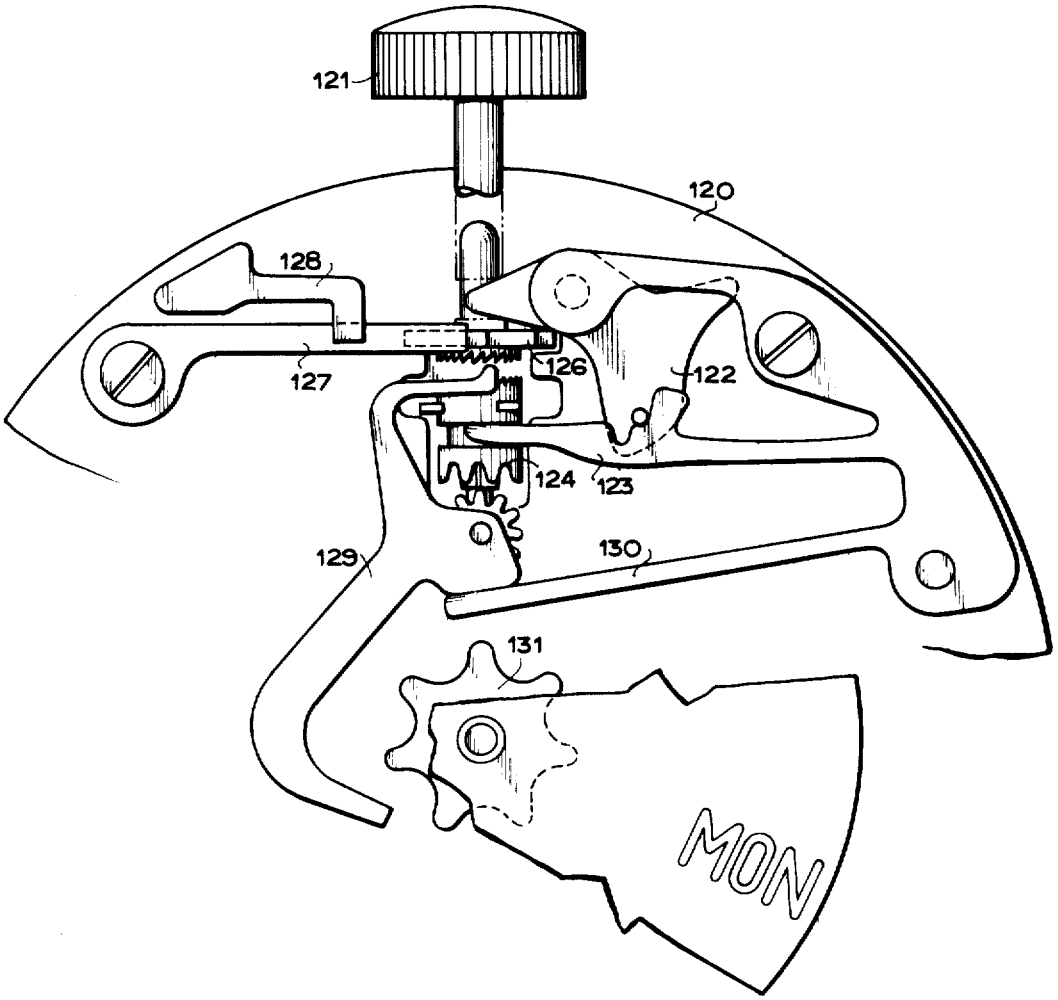
FIGS. 10 to 12 are plan views of a mechanical embodiment of this invention applied to a timepiece.
Figure 11:
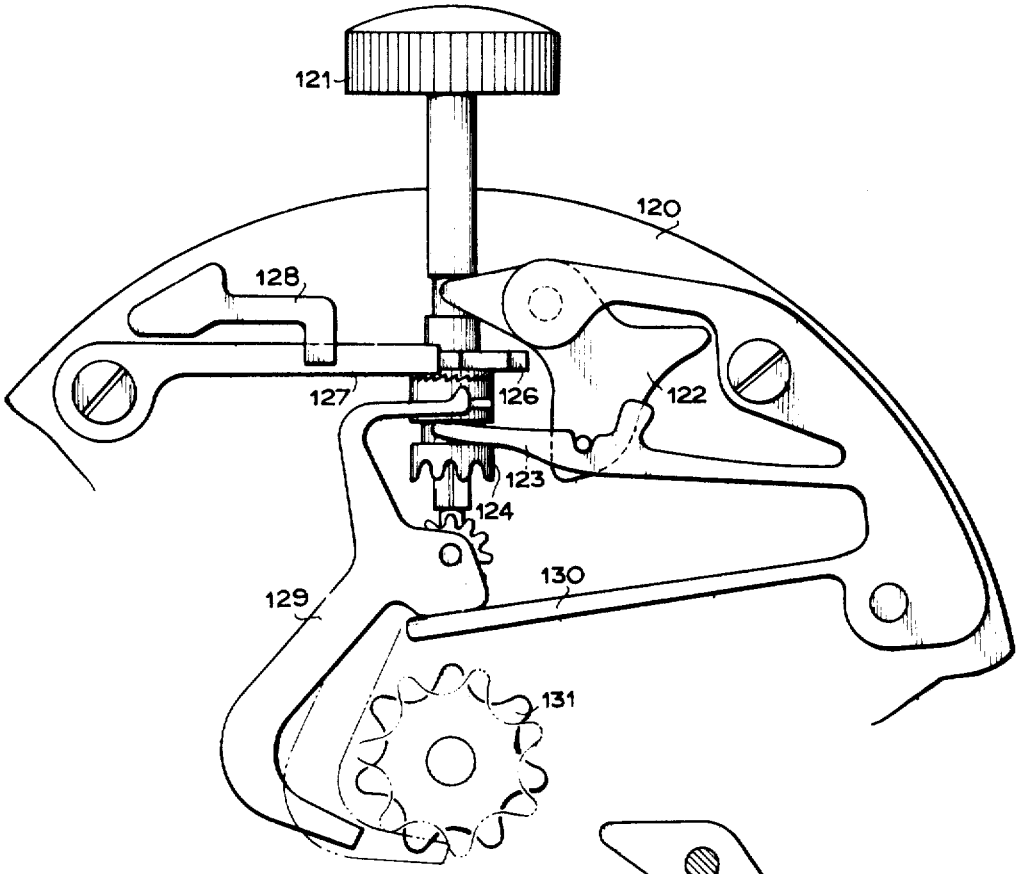
Figure 12:
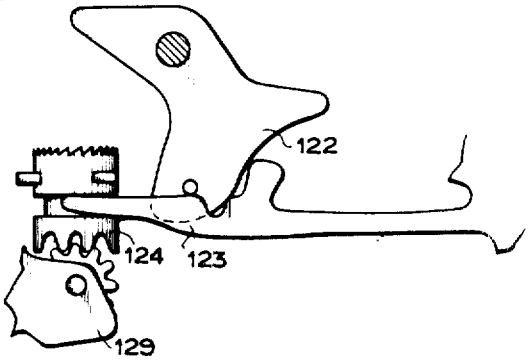

In FIGS. 10 to 14, reference numeral 121 depicts a winding crown and a setting lever 122 is pivotably supported on the axis. When the winding crown 121 is pulled outward by two steps, the setting lever 122 is arranged at three positions as shown in FIGS. 10 to 12. The base of a yoke 123 is fixed to the base plate 120, but the yoke 123 may be arranged on three stage positions like the setting lever 122 by its resilience and the pressure of a pin 122*b* of the setting lever 122. A clutch wheel 124 is engaged with the portion of a crown shaft 125 with being movable in accordance with the movement of the yoke 123. A switch driving wheel 126 is engaged with the circular portion of the crown shaft 125, of which the movement toward the axis is limited by the base plate 120. A switch spring 127 is not contacted with a contact 128 at the time-keep mode. A date wheel setting lever 129 is rotatably supported on the axis and is prevented from contacting a date wheel 131 by means of a spring 130 at time-keep mode.

Figure 13:
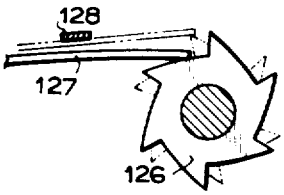
FIGS. 13 and 14 are horizontal sections to a crown shaft.
Figure 14:
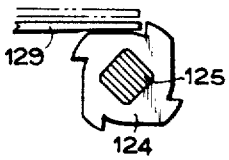

FIGS. 13 and 14 are sections vertical to the crown shaft 125. At the position where the crown 121 is depressed, that is, time-keep mode, the rotation of the crown 121 causes the clutch wheel 124 to rotate only, but does not cause the correcting operation as shown in FIG. 10. When the crown 121 is pulled outward the clutch wheel 124 is shifted by means of the yoke 123 at the position as shown in FIG. 11 and is engaged with the switch driving wheel 129 so that the protrusion 124*a* of the clutch wheel 124 may be engaged with the date wheel setting lever 129. When the crown 121 is rotated counter-clockwise the rotation of the clutch wheel is delivered to the switch driving wheel 126 so as to drive the switch spring 127 whereby the contact 128 is contracted as the two-dotted chain line as FIG. 13. While, the date wheel setting lever 129 is only lifted to a position indicated by one-dotted chain line of FIG. 14 and the date wheel 131 is prevented from being driven. When the crown 121 is rotated clockwise, there is not delivered to the switch driving wheel 126 the rotation of the clutch wheel 124 and the switch is not operated. However, the protrusion of the clutch wheel 124 causes the date wheel setting lever 129 to rotate on the axis so as to drive the date wheel 131 by one step as indicated by a two-dotted chain line in FIG. 11 whereby the date display is corrected.

When the crown 121 is pulled outward further, the clutch wheel 124 is engaged with the setting wheel so that the date wheel setting lever 129 ceases from being engaged with the switch driving wheel 126. Under the condition, the rotation of the crown 121 results in correcting the hour and minute hands like the conventional timepiece.

Figure 8:
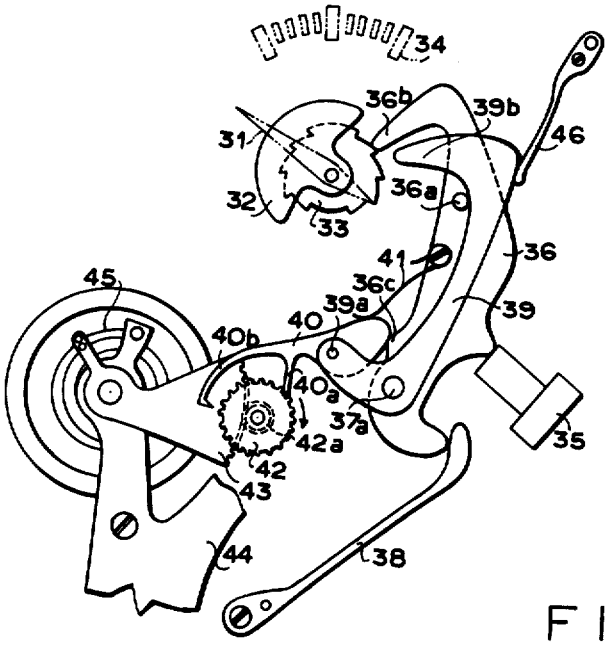
Figure 9:
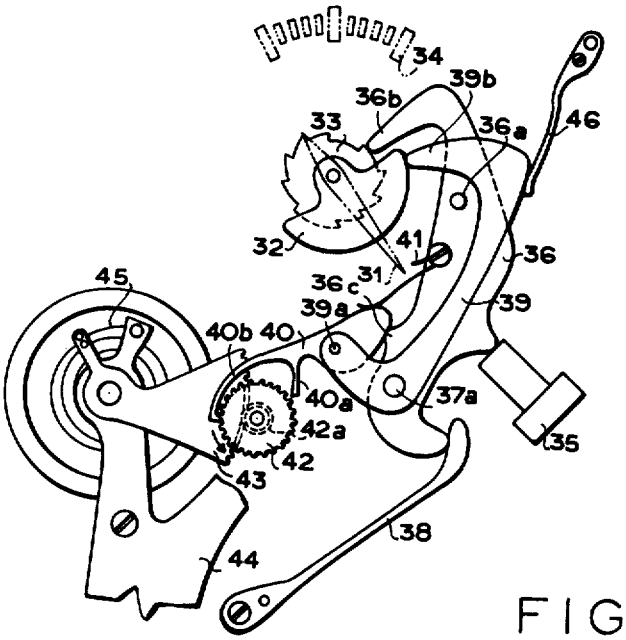

FIGS. 7 to 9 indicate the third embodiment of the present invention wherein the amount of fast and slow adjustment is indicated utilizing one of the hands for indicating time.

In FIG. 7 which shows the normal state, the reference numeral 31 indicates a minute hand, 32 a cam for discriminating the moving direction of a regulator and 33 a cam for setting the amount of slow and fast adjustment, the minute hand 31 and cams 32 and 33 being secured to a complete munite wheel (not shown). The diameter of the cam 33 is selected in accordance with the position of the minute hand 31. Each graduation 34 is for an hour corresponding to one second in the slow and fast adjustment for a day. The reference numeral 35 identifies a button for slow and fast adjustment which is manually operable outside of the case. A lever 36 for determining the angle of rotation of the regulator 43 is rotatably supported on a shaft 37*a* secured on a base plate (not shown) and biased to rotate in the clockwise direction by a spring lever 38. The lever 36 is engaged with the button 35. Another lever 39 for determining the moving direction of the regulator 43 is rotatably supported on the shaft 37*a* and biased to revolve in the counter-clockwise direction by a leaf spring 46 fixed at one end to the base plate to be pressed against a pin 36*a* provided on the lever 36. On a rivet 39*a*, fixed to the lever 39, there is supported a click or pawl 40 which has a pair of resilient arms 40*a* and 40*b* and is biased by a wire spring 41 fitted to the lever 36 to be turned in the clockwise direction so as to contact with a projection 36*c* on the lever 36. Furthermore, there is provided a regulator wheel 42 which is integrated with a regulator pinion 42*a* and rotatably supported on a balance cock 44 and hairspring 45.

When a fast adjustment for two seconds a day is desired, the button 35 is manually pushed to a state in which the minute hand 31 is placed at the point showing ten o'clock, i.e., two hours before twelve o'clock. In this state, the button, as shown in FIG. 8, causes the lever 36 to rotate in the counter-clockwise direction about the shaft 37*a* against the spring lever 38 and to engage its end with the cam 33. The lever 39 is pressed against the cam 33. The lever 39 is pressed into engagement with the pin 36*a* which is integral with the lever 36 by means of the spring lever 46. The click 40 which is restricted by means of wire spring 41 and the projection 36*c* of the lever 36 are rotated about the shaft 37*a* just as if they were attached together and hence the first arm 40*a* engages the regulator wheel 42 and rotates it. The rotation of the regulator wheel 42 results in the rotation of the regulator 43 to adjust the stepping ratio of the timepiece mechanism.

FIG. 9 illustrates the state in the course of slow adjustment for five seconds a day. In this case the minute hand 31 is placed at the point showing 5 o'clock, i.e., five hours after twelve o'clock, and then the button 35 is pushed down. The levers 36 and 39 are rotated together in the initial stage of the movement of the button 35 and thereafter the lever 39 stops rotating when the bill **39*b* thereon engages the cam 32 which is associated with the lever 39 during the minute the hand 31 is positioned between zero to thirty minutes. Accordingly, the rotational axis of the click 40 is switched from the shaft 37*a* to the rivet 39*a*. Further movement of the button 35 continues to rotate only the lever 36 and then the end 36*b* thereof contacts the cam 33, thereby rotating the click 40 about the rivet 39*a* in the counter-clockwise direction against the wire spring 41 by means of the projection 36*c* on the lever 36. As the result, the second arm 40*b* engages with the regulator wheel 42 to rotate both the regular wheel and the regulator 43 via the regulator pinion 42*a*** in the clockwise direction.

In the third embodiment, although the minute hand is used as an indicator for the amount of slow and fast adjustment necessary, it is possible to use the second hand, hour hand, alarm hand, chronograph hand, register ring and the like for the same purpose. Also, in some cases the following modifications are desirable, the details of which are obvious to those skilled in the art:

(1) Reversing the direction of the indication of the slow and fast adjustment on the graduation.

(2) In case of timepieces with an oscillator, slow and fast adjustment may be performed by changing the dividing ratio of a divider in lieu of turning the regulator in mechanical timepieces.

(3) Using an electronic memoery utilizing a counter for memorizing the amount of adjustment.

In case of electronic timepieces, it is possible to construct the slow and fast adjusting mechanism more simply, because the indicated amount is memorized. Namely, the mechanical part for indication as in the embodiment set forth as above in FIG. 9 can be omitted and the necessary part to be replaced therewith may be a set of gate circuits as in FIG. 5.

Alternatively, the construction, in which the operation of the secondary function can be done when the predetermined display such as for second indicates the desired indication, allows performance of the secondary function without any change in indication for the primary function. Furthermore, where a simple arithmetic circuit is utilized, it is possible to restore the indication for the primary function by memorizing the necessary information in the timepiece and detecting that the operation is for the secondary function, even if the indication for the primary function is altered.

Also, it is possible to set the desired function by using the indication for the primary function, if the secondary function is memorized as a code. The secondary function includes the designation of the measuring mode in a chronograph, the setting the alarm time in an alarm watch or clock in which a plurality of alarm times can be set, and the designation of the setting figure in a digital timepiece, the relationship between the function and the code preferably being indicated on the back face of the timepiece case.

For the purpose of practicing this invention, the manually operable member for performing the latent or secondary function may be a crown, button, register ring or setting member for the alarm. The instructions for the secondary function can be made by pushing, pulling or rotating the member. In the case where the manually operable member is for performing the basic function of the timepiece, the descrimination of two kinds of functions may be made by selecting the order of the operation of the plural members, by operating the member for the predetermined times, by moving the minute hand in accordance with the key word, by operating the member within the predetermined time zone or by any combination thereof. Examples of the secondary function include the correction of the calendar indication, the slow and fast adjustment and the setting of alarm time.

Briefly speaking, the system according to this invention can form a closed loop including the previous confirmation of the operation by indicating of the program of the secondary function, namely, the feedback of the operation to the operator, resulting in indication of the reliability to the operation, obtaining ease of mind. It can be said that such system is very useful for a timepiece which is an article close to the human life.

The display means for the secondary function is not limited to the mechanical point or leaf set forth above. Suitable display includes an electro-optical display element such as a liquid crystal cell, light-emitting diode and light-polarizing piezo-electric cell and an electrochemical display such as an electrochromism cell.

The usage of the timepiece with the secondary function can be expanded to the another field wherein the timepiece is used in combination of a blood-pressure meter for producing an alarm when the detected blood pressure reaches the predetermined point.

What is claimed is:

1. A timepiece comprising:

time measuring means including an oscillator as a time base and a timekeeping means synchronized with said oscillator for keeping time information, driving means, partially mechanical time display means rotated by said driving means for displaying at least part of the time information kept by said time keeping means when said time keeping means is in a time keeping mode, said time display means including an input data display part including at least an hour display, a minute display and a calendar display, said input data display part having a display which is changeable by a display changing means to display a data to be delivered to the time measuring means when the time measuring means is in an input mode and to display the time information when the time measuring means is in the time keeping mode, information means included in said time measuring means for providing additional time-related information, inserting means for inserting the data into the information means, said inserting means including an actuating member for selectively actuating the time keeping mode and the input mode, a discriminating means for determining whether the timepiece is in the time keeping mode or input mode in accordance with the actuating member, and control means for controlling the transmission of the data to the information means, said controlling means transmitting during the input mode the data corresponding to the display of the input data display part, and said timekeeping means keeping the time information independentaly of the display of the input data display part when said time measuring means is in the input mode and including a compensating means for providing the display of the input data display part with information corresponding to the time information of the time keeping means when the mode of said time measuring means is changed from the data input mode to the time keeping mode.

2. The timepiece claimed in claim 1 wherein means are provided with said actuating member to change the display.

3. The timepiece claimed in claim 1 wherein said time keeping means keeps the time information independently of the display of the input data display part when said time measuring means is in the input mode and wherein a compensating means is provided for giving the display of the input data display part information corresponding to the time information of the time keeping means when the mode of said time measuring means is changed from the data input mode to the time keeping mode.

4. The timepiece claimed in claim 1 wherein said input display part includes a calendar display.

5. The timepiece claimed in claim 1 where said information means includes a calendar mechanism which sequentially and automatically changes the display to show the first day of each month following an end of a preceeding month.

6. The timepiece claimed in claim 1 wherein said information means includes a fast and slow adjustment device.

* * * * *